United States Patent [19]

Fujie et al.

[11] Patent Number: 4,493,788

[45] Date of Patent: Jan. 15, 1985

[54] FOAMABLE ELECTROCONDUCTIVE POLYOLEFIN RESIN COMPOSITIONS

[75] Inventors: Akira Fujie; Minoru Hisamatsu, both of Suzuka, Japan

[73] Assignee: The Dow Chemical Company, Midland, Mich.

[21] Appl. No.: 406,817

[22] Filed: Aug. 10, 1982

[51] Int. Cl.[3] ..... H01B 1/06

[52] U.S. Cl. ..... 252/511; 524/495; 524/496; 521/82; 521/143; 521/144; 521/79

[58] Field of Search ..... 252/511, 182, 502; 524/495, 496; 521/82, 143, 144, 79

[56] References Cited

U.S. PATENT DOCUMENTS

| | | | |
|---|---|---|---|
| 3,072,584 | 1/1963 | Karpovich | 524/495 |
| 4,229,396 | 10/1980 | Suh et al. | 521/82 |
| 4,231,901 | 11/1980 | Berbeco | 252/511 |
| 4,287,117 | 9/1981 | Theysohn et al. | 524/496 |
| 4,301,040 | 11/1981 | Berbeco et al. | 252/511 |
| 4,317,888 | 3/1982 | Watanabe et al. | 521/144 |
| 4,431,575 | 2/1984 | Fujie et al. | 252/511 |

*Primary Examiner*—Josephine L. Barr

*Attorney, Agent, or Firm*—Bruce M. Kanuch

[57] ABSTRACT

A foamable, electroconductive polyolefinic resin composition comprising 70 to 95 weight percent of a polyolefinic resin and 5 to 30 weight percent of an electrically-conductive particulate furnace black having a specific surface area of at least 900 square meters per gram. Foam products prepared from this composition, preferably by extrusion foaming, are particularly useful for packaging sensitive electronic parts.

5 Claims, No Drawings

FOAMABLE ELECTROCONDUCTIVE POLYOLEFIN RESIN COMPOSITIONS

The present invention relates to a foamable polyolefinic resin composition suited for the production of electroconductive, low-density closed cell foams.

Generally it is difficult to expand a polyolefin resin in commercial production. To improve the viscoelasticity of a molten polyolefin resin before expansion, it is customary to modify the resin by crosslinking or by blending with other resins.

Further, it has long been thought difficult to produce highly-expanded foams from an intractable polyolefin resin having a large quantity of carbon black dispersed therein. For example, in disclosing a process for producing a polypropylene resin foam containing carbon black, Japanese Patent Application, laid open as No. 48-47,958(1973), states that a carbon black content exceeding 0.1 part by weight does not add to the effectiveness to reduce the cell size, but is rather undesirable in that as the cells grow they will be aggregated into larger cells. Carbon black acts as a nucleating agent and has an adverse effect making the foam cells coarser if added in an amount exceeding a certain limit.

Since electrically-conductive carbon black is more apt to agglomerate than ordinary carbon black, a resin containing a relatively large amount of electrically-conductive carbon black will have an insufficient viscoelasticity or melt strength to retain in the cells sufficient gas pressure for expansion. The cell walls formed of such a resin having a high carbon black content will fissure upon expansion. Further, highly-expanded foams containing electrically-conductive carbon black substantially fail to show desired electroconductivity because interparticle distances of the carbon black increase as the cell walls are extended greatly upon expansion. The problem of successfully producing highly-expanded polyolefinic resin foams having a large quantity of carbon black therein has remained unsolved.

Accordingly, an object of the present invention is to provide a foamable polyolefinic resin composition useful for the production of electrically-conductive foams. More specifically, the present invention aims to provide such a foamable polyolefinic resin composition, especially of a type using a non-crosslinked polyolefinic resin, which can be processed with facility into electrically-conductive low-density foams of closed fine cell structure having substantially uniform cell sizes with excellent shock-absorbing properties.

The present invention provides a foamable polyolefinic resin composition for an electrically-conductive foam comprising: a mixture of 70 to 95 percent by weight of a polyolefinic resin and 5 to 30 percent by weight of an electrically-conductive, hollow particulate furnace black having a specific surface area of at least 900 square meters per gram, and a blowing agent, wherein the furnace black and blowing agent are homogeneously dispersed in the polyolefinic resin.

The invention also provides an electroconductive polyolefin foam prepared by extrusion foaming of the heat-plastified resin mixture, and especially such foams expanded to five or more times their original volume.

This invention requires (1) an electrically-conductive, hollow particulate furnace black having a specific surface area of at least 900 square meters per gram, (2) a polyolefinic resin, and (3) a blowing agent.

Unlike other electrically-conductive carbon blacks, the electrically-conductive furnace black used in the present invention has a hollow particulate structure and an extremely large specific surface area. The object of the present invention can be achieved only by using a furnace black having 900 square meters per gram or greater specific surface area.

As to why such a selected furnace black is contributive to production of highly-expanded electrically-conductive polyolefinic resin foams, its characteristic particulate structure provides a unique mechanism of electric conduction due to a so-called tunnel effect and therefore it can secure a sufficient electroconductivity to the foam even if its content is significantly decreased as compared with other electrically-conductive carbon blacks used conventionally. Also, it is supposed that because of its large specific surface area and hollow particulate structure the furnace black surfaces will be apt to absorb the polyolefinic resin, and the adsorption will be prompted by the action of the blowing agent, especially, when a volatile blowing agent is used. As a result, since the resin itself will be quasi-crosslinked, the cell walls as formed will have a viscoelasticity fit for expansion and a sufficient gas pressure will be retained in the cells to permit high expansion. Further, even when the cell walls are extended, the furnace black particle will be kept homogeneously dispersed in the resin due to the aforementioned quasi-crosslinked structure.

As a typical example of such furnace blacks, well-known in this field of art is Ketjenblack EC (trade name of electrically-conductive carbon black produced by Akuzo Chemie N.V.) having 1,000 $m^2/g$ or larger specific surface area.

In the foamable polyolefinic resin composition according to the present invention, the furnace black content ranges generally from 5 to 30 percent by weight of the mixture of furnace black and polyolefinic resin. It may vary in this range depending on the type of the base resin and blowing agent used as well as on the shape and properties (density, mechanical properties, etc.) of the intended foam. If the furnace black content is lower than 5 percent by weight, the resultant foam cannot have a sufficient electroconductivity. With a furnace black content exceeding 30 percent by weight, it is not possible to obtain a highly-expanded foam of closed-cell structure. Also the resultant foam will have poor shock-absorbing properties because it loses flexibility, one of the desirable features of polyolefinic resin foams.

The polyolefinic resin herein referred to generically denote resins mainly composed of olefins including: low, medium and high-density polyethylenes; isotactic polypropylene; poly-1-butene; copolymers of ethylene or propylene and other monomers copolymerizable therewith such as propylene-1-octene-ethylene copolymer, ethylene-propylene copolymer, ethylene-vinyl acetate copolymer, ethylene-acrylic acid copolymer, ethylene-ethyl acrylate copolymer, and ethylene-vinyl chloride copolymer; and zinc, sodium, calcium and magnesium salts of ethylene-acrylic acid copolymer. These resins may be used individually or as mixtures of two or more of them. Among these resins, polyethylene and ethylene-vinyl acetate copolymer are preferable. More preferably, a low-density polyethylene with a melt index of 1 to 30 and a density of 0.910 to 0.930 is used.

For mixing the electrically-conductive furnace black with the base resin, any well-known machine having a kneading capability may be used, including a Banbury mixer and similar internal mixers, a roll mill, or a single-screw and twin-screw extruders.

For adjusting the carbon content of the kneaded mixture accurately as desired, dryblending or masterbatching process may be used.

The foamable polyolefinic resin composition of the present invention may be expanded into a foam by well-known methods. For example, conventional extrusion foaming techniques can be employed in which the resin composition is heated to be melted or heat-plastified and a blowing agent is added thereto at an elevated temperature under high pressure. Then, the resultant molten or heat-plastified mixture is extruded into a lower-pressure zone to be expanded into a foam. Alternatively, a batch method may be used in which the blowing agent is added to the molten resin composition at elevated temperature under high pressure and then pressure is removed therefrom. In another method, the resin composition may be crosslinked with electron beams or chemical crosslinking agent if desired. Then, the crosslinked resin composition is mixed with a blowing agent and heated to be expanded into a foam. However, the present invention is particularly effective when applied to the aforementioned extrusion foaming of polyolefin resin compositions and especially when such compositions are to be expanded to five or more times their original unexpanded volume.

For expanding the polyolefinic resin composition of the present invention, any conventional chemical or volatile blowing agents may be used. However, especially preferable for the resin composition of the present invention are volatile organic blowing agents having boiling points lower than the melting point of the polyolefinic resin used. Typical examples of such preferable blowing agents include: lower hydrocarbons such as propane, butane, pentane, pentene and hexane; and halogenated hydrocarbons such as methylene chloride, methyl chloride, trichlorofluoromethane, dichlorofluoromethane, chlorodifluoromethane, chlorotrifluoromethane, dichlorodifluoromethane, 1,1-difluoroethane, 1-chloro-1,1-difluoroethane, 1,2-dichlorotetrafluoroethane and monochloropentafluoroethane. These blowing agents may be used also as their mixtures.

Chemical blowing agents suitable for the resin composition of the present invention include azodicarbonamide, azobisisobtyronitrile, dinitrosopentamethylenetetramine, and p-toluenesulfonyl hydrazide. These chemical blowing agents may be used also in conjunction with the aforementioned volatile organic blowing agents.

Further, the polyolefinic resin composition according to the present invention may contain minor amounts of a lubricating agent such as zinc stearate or other metal soaps or wax. Besides these, an ultraviolet light absorber, anti-oxidizing agent and/or stabilizer may be used as required.

The foamable polyolefinic resin compositions according to the present invention may be expanded into almost any shapes including sheets, blocks, rods and pipes, or it may be used for electric wire and cable coverings or sheathings or as a variety of other formed articles.

The present invention is further illustrated by the following examples and accompanying comparative or reference experiments.

EXAMPLES 1 THROUGH 4

In a 5-liter Banbury mixer, 79 percent by weight of a low-density polyethylene (grade M-2125 produced by Asahi-Dow Limited, with the density of 0.921 g/cm$^3$ and the melt index of 2.5), 20 percent by weight of Ketjenblack EC (product of AKZO N.V., with the specific surface area of 1,000 m$^2$/g) and 1 percent by weight of wax were kneaded under heat at 750 rpm for 15 minutes with the mixer jacket temperature set at 120° C. Consequently, a pelletized composition was obtained. The thus obtained pelletized composition was dry-blended with the polyethylene of the same grade as above to prepare mixtures having various furnace black contents as shown in Table 1.

Each of the resultant mixtures was fed to extrusion-foaming equipment comprising a 30 mm inside barrel diameter extruder with a line for injecting a blowing agent into its kneading zone and a heat exchanger with a die having a 3.0 mm orifice. Twenty-three parts by weight of 1,2-dichlorotetrafluoroethane was mixed as a blowing agent with 100 parts by weight of the molten mixture under pressure at an elevated temperature to obtain a molten resin composition, which was then extrusion-expanded through the die into the atmosphere to produce a cylindrical foam continuously. The Ketjenblack EC content and the properties of the resultant foams are shown in Table 1.

REFERENCES 1 THROUGH 4

Foams were obtained in the same manner as in Examples 1 through 4 except for using acetylene black or channel black each having a specific surface area of 30 to 70 m$^2$/g instead of Ketjenblack EC. The acetylene black and channel black contents are shown in Table 2 together with the properties of the resultant foams.

TABLE 1

| Example | Ketjenblack EC Content (wt %) | Foam Density (g/cm$^3$) | Percent Closed Cells | Volume Resistivity (Ω/cm) |
|---|---|---|---|---|
| 1 | 5 | 0.034 | 94 | $10^{14}$ |
| 2 | 10 | 0.037 | 89 | $10^{8}$ |
| 3 | 15 | 0.038 | 82 | $10^{6}$ |
| 4 | 20 | 0.045 | 76 | $10^{6}$ |

TABLE 2

| Reference | Ketjenblack EC Content (wt %) | Foam Density (g/cm$^2$) | Percent Closed Cells | Volume Resistivity (Ω/cm) |
|---|---|---|---|---|
| 1 | Acetylene black, 10% | 0.069 | 32 | $10^{15}$ |
| 2 | Acetylene black, 20% | 0.158 | 21 | $10^{10}$ |
| 3 | Channel black, 10% | 0.056 | 29 | $10^{16}$ |
| 4 | Channel black, 20% | 0.143 | 18 | $10^{16}$ |

EXAMPLES 5 AND 6

In a 5-liter Banbury mixer, 79 percent by weight of an ethylene-vinyl acetate copolymer (EVATATE D-2021 produced by Sumitomo Chemical Co., Ltd., with 10 weight percent vinyl acetate content, 0.93 g/cm$^3$ density and 1.5 MI), 20 percent by weight of Ketjenblack EC having the specific surface area of 1,000 m$^2$/g and 1 percent by weight of a wax were kneaded under heat at 750 rpm for 15 minutes with the mixer jacket temperature being set at 90° C. Consequently, a pelletized composition was obtained. Then, the pelletized composition was dry-blended with the copolymer of the same grade as above to prepare mixtures having the carbon black contents of 10 and 15 percent by weight, respectively.

Each of the resultant mixtures was extrusion-foamed by repeating the same procedure as in Examples 1 through 4 except for using a mixed blowing agent consisting of 75 parts of weight of 1,2-dichlorotetrafluoroethane and 25 parts by weight of monochloropentafluoroethane. The properties of the resultant foams are shown in Table 3.

TABLE 3

| Example | Ketjenblack EC Content (wt %) | Foam Density ($g/cm^2$) | Percent Closed Cells | Volume Resistivity (Ω/cm) |
|---|---|---|---|---|
| 5 | 10 | 0.038 | 90 | $10^9$ |
| 6 | 15 | 0.042 | 88 | $10^6$ |

The low-density, fine size, closed-cell foams expanded from the polyolefinic resin compositions of the present invention are electrically conductive and shock-absorbing concurrently. Such foams are particularly useful as a shock-absorbing material for packaging electronic parts sensitive to static electricity and impact.

We claim:

1. An electroconductive polyolefin resin foam containing 70 to 95 percent by weight of a polyolefinic resin and 5 to 30 percent by weight of an electrically-conductive, hollow particulate furnace black having a specific surface area of at least 900 square meters per gram.

2. The electroconductive resin foam of claim 1 wherein the polyolefin resin is a polyethylene or ethylene-vinyl acetate copolymer resin.

3. The electroconductive resin foam of claim 1 wherein the polyolefin resin is polyethylene with a melt index of 1 to 30 and a density of 0.910 to 0.930.

4. The electroconductive resin foam of claim 1 prepared by extrusion foaming with a volatile organic blowing agent.

5. The electroconductive resin foam of claim 1 wherein the volatile organic blowing agent is a $C_1$–$C_2$ fluorocarbon or mixture thereof.

* * * * *